United States Patent [19]

Loda

[11] 4,163,172

[45] Jul. 31, 1979

[54] SLIDING SPARK SOURCE COLD CATHODE ELECTRON GUN AND METHOD

[75] Inventor: Gary K. Loda, Danville, Calif.

[73] Assignee: Systems, Science and Software, Hayward, Calif.

[21] Appl. No.: 813,892

[22] Filed: Jul. 8, 1977

[51] Int. Cl.[2] ..... H01J 1/46; H01J 21/10

[52] U.S. Cl. ..... 313/302; 313/304; 313/420; 313/309; 313/409; 313/200; 315/111.8

[58] Field of Search ..... 315/36, 98, 111.8, 111.9; 313/409, 420, 302, 303, 304, 200, 203, 298, 309

[56] References Cited

U.S. PATENT DOCUMENTS

| | | | |
|---|---|---|---|
| 3,336,499 | 8/1967 | O'Meara | 315/36 |
| 3,863,163 | 1/1975 | Farrell et al. | 313/304 |
| 4,068,192 | 1/1978 | Hintz et al. | 315/323 |
| 4,079,328 | 3/1978 | Cleland et al. | 313/420 |
| 4,091,306 | 5/1978 | Hant | 313/420 |

FOREIGN PATENT DOCUMENTS

| | | | |
|---|---|---|---|
| 376826 | 10/1973 | U.S.S.R. | 313/304 |

*Primary Examiner*—Saxfield Chatmon, Jr.
*Attorney, Agent, or Firm*—Robert B. Block

[57] ABSTRACT

A broad beam DC cold cathode electron gun with a plurality of plasma emitters formed by a capacitively coupled sliding spark assembly operable as a steady state as well as a pulsed device. Stabilization of the plasma emission current is attained through a feedback loop between the spark assembly and the grid bias supply.

3 Claims, 3 Drawing Figures

SLIDING SPARK SOURCE COLD CATHODE ELECTRON GUN AND METHOD

BACKGROUND OF THE INVENTION

The present invention relates to a broad beam electron gun and method and more particularly to an extended spark cold cathode electron gun suitable for radiation processing and for laser stimulation, operable either in pulsed or DC mode.

The high energy electron beam obtainable from an electron gun is capable of inducing a rearrangement of molecules in many materials. This has been used for synthesizing and cross-linking of polymers, hydrogenation, the curing of paint and a number of similar processes and operations. Reference is made to U.S. Pat. No. 3,925,670 for "Electron Beam Irradiation of Materials Using Rapidly Pulsed Cold Cathodes", assigned to the present assignee, which gives an overview of the present state of the art.

Currently available electron guns can be roughly classified in terms of electron emission methods; that is, into thermionic (hot) cathode electron guns with continuous (CW) operation, pulsed cold cathode electron guns and field emission electron guns. The hot cathode guns may be compared to conventional triodes in which electrons are ejected from a hot filament. In the cold cathode operation a pulsed negative potential applied to a metallic projecting element is employed to cause generation of a plasma from which electrons are drawn. In the field emission guns a high field is used to draw electrons from a fine tungsten point. None of these types of electron guns is capable of providing all the characteristics and requirements desired particuarly with respect to efficiency, reliability, and ruggedness.

The usefulness of a thermionic cathode is offset by numerous drawbacks in structural and operational parameters, while the superior features of a cold cathode are limited by its inability to produce pulses of a long duration. If the projection of a cold cathode is shaped as a longitudinal edge, a plasma sheet from which the electrons are to be extracted forms in front of the cathode. The sheet is inherently unstable and not easily controlled. Within a very short period, for example, several microseconds, it diffuses across the cathode-anode gap and produces an arc which effectively interrupts propagation of the beam. The pulses obtainable from a cold cathode electron gun are thus of very short length and of limited usefulness for certain processes. Polymerization, for example, is affected not only by the radiation dose, that is, the total amount of radiation directed onto the material, but also by the rate at which the dose is delivered. The high dose rate of very short electron beam pulses, of the order of microseconds, elicits chemical reactions which may be different from those produced by the impact of long pulses or continuous radiation.

In choosing between a thermionic and a cold cathode electron gun for a specific application it has thus been necessary to make a compromise decision and to weigh the respective advantageous characteristics of one against the other. There is, therefore, a need for a new and improved electron gun for radiation processing, laser stimulations and other purposes.

OBJECTS AND SUMMARY OF THE INVENTION

It is, therefore, a general object of the present invention to provide a broad beam electron gun which will overcome the limitations and disadvantages of prior art.

Another object of the invention is to provide a cold cathode electron gun which combines the advantages of thermionic and cold cathode electron gun devices, and which can be operated in pulsed or continuous mode.

Yet another object of the invention, is to provide a cold cathode electron gun in which the formation and the life characteristics of the plasma can be controlled.

Still another object of the invention is to provide a cold cathode electron gun capable of providing irradiation at a uniform low dose rate.

A further object of the present invention is also to provide for a method and apparatus of the above character for producing a controlled large volumetric discharge in which the electrons pass through a gas under the influence of an electric field to cause laser stimulation while simultaneously maintaining an ionization level below values which would create inherent discharge instabilities.

Another object of the present invention is also to provide for a method and apparatus of the above character for producing the complete laser stimulation or flourescence after passage through a suitable gas.

In accordance with the above objects a broad beam electron gun is provided comprising cathode means including an insulating substrate with a plurality of discrete electrodes on the substrate with gaps therebetween lying along a common axis. Anode means are spaced from and juxtaposed with respect to the cathode means. High voltage supply means are connected between the cathode and anode means. Cathode supply means apply a voltage across the plurality of electrodes to generate a moving spark along the electrodes and a plasma from which electrons are drawn to the anode.

DETAILED DESCRIPTION OF THE PREFERRED EMBODIMENT

Figure 1:
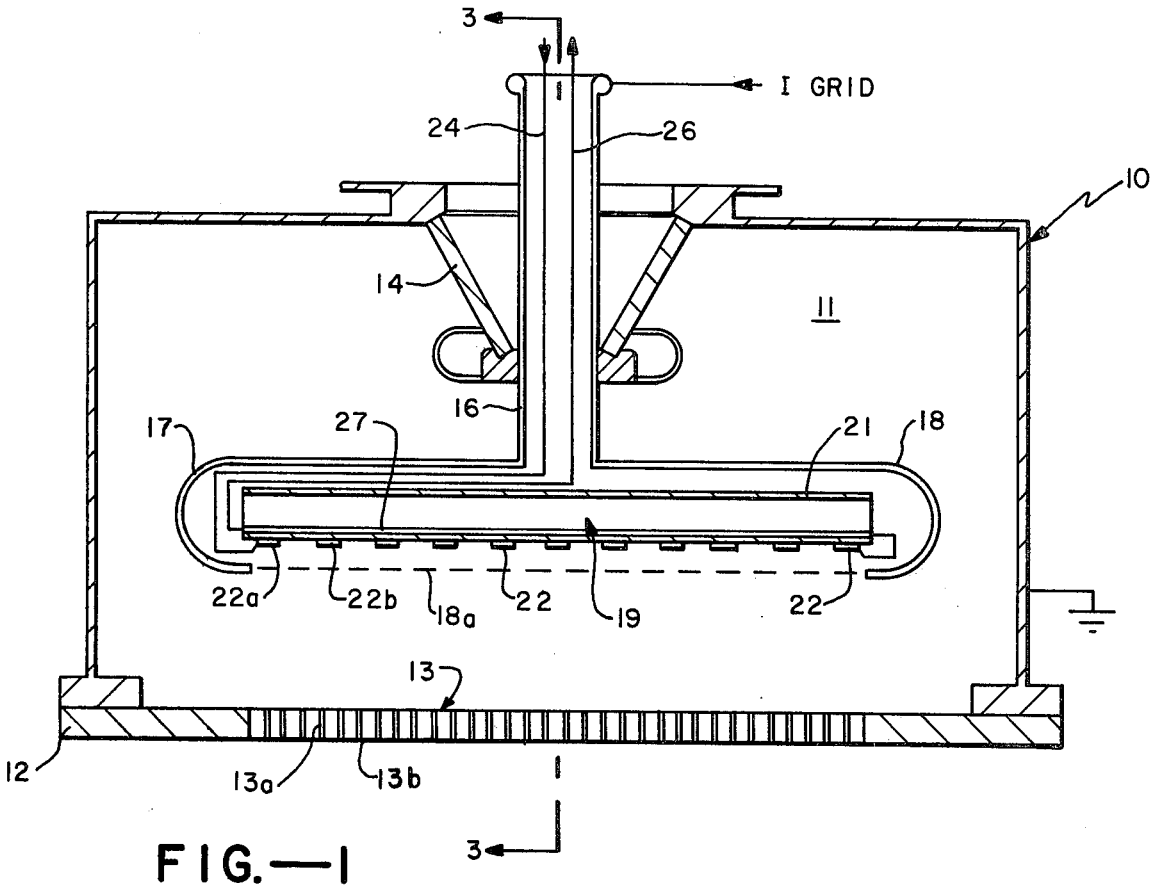
FIG. 1 is a simplified longitudinal cross-sectional view of an electron gun constructed in accordance with the present invention.
Figure 3:
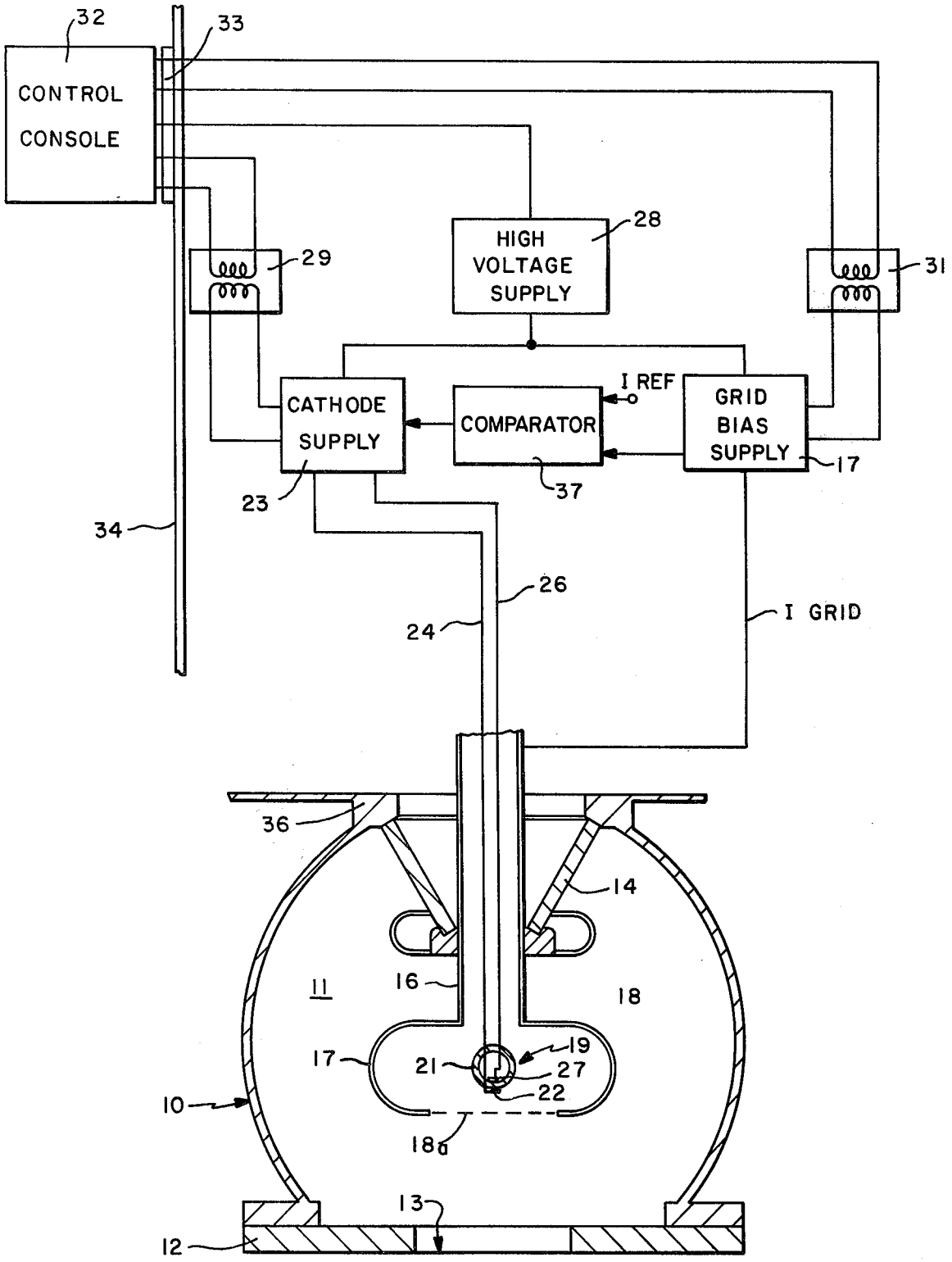
FIG. 3 is a simplified sectional view taken along line 3—3 of FIG. 1 but includes the electrical network utilized in the present invention.

Referring now to FIGS. 1 and 3, the electron gun of the present invention includes a grounded conductive shell 10 of cylindrical configuration which forms a chamber 11 which is under a high vacuum. The lower portion of shell 10 terminates in a plate 12 which includes an anode window 13 through which electrons may be emitted at an object for the purpose of radiation processing, laser stimulation and the like. Window 13 is, of course, impervious to air. The upper portion of shell 10 includes an isolation bushing 14 for retaining the cathode and screen grind assemblies of the electron gun of the present invention. In addition, bushing 14 provides high voltage isolation between the cathode and shell 10.

Anode window includes a generally flat, ribbed support plate **13*a* made of conductive material and having a high percentage of open channels extending therethrough and between its upper and lower surfaces. Suitable support plates may be made if solid plate stock having machined grooves extending back and forth as shown. Anode window also includes a thin conductive sheet 13***b* in contrast with the lower, or outermost surface of the support plate as held thereto by a suitable peripheral flange (not shown).

Cathode and grid assembly includes an entrance tube 16 connected to a source of grid current and voltage (FIG. 3) designated grid bias supply 17, an elongated flattened portions 18 and the actual screen 18*a* located intermediate the anode 13 and a cathode assembly 19.

Figure 2:
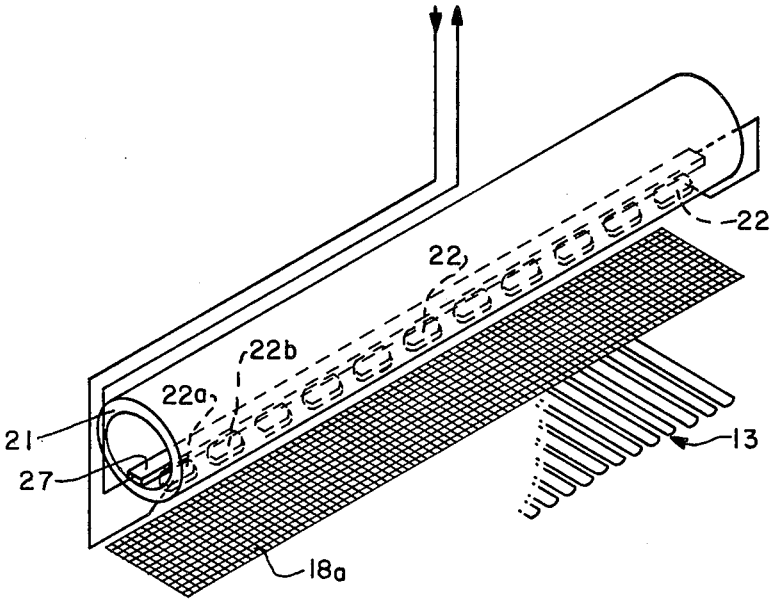
FIG. 2 is a schematic, perspective view of a part of FIG. 1.

Cathode assembly 19 includes an insulating substrate 21 as best shown in FIG. 2 which is actually a ceramic cylindrical shell having fixed along one outer surface facing the other a plurality of discrete electrodes 22 with gaps therebetween. While the drawing shows a preferred embodiment in which the shape of each individual discreet electrode 22 is elongate and elliptical, with its major axis lying in the direction of the array, it will be understood that the shape of each electrode may be circular, square or other shape, provided that such shape presents a smoothly contoured edge facing its adjacent electrode. A cathode supply unit 23 supplied a voltage across electrodes 22 to thereby generate the plasma. More specifically, conductors 24 and 26 from cathode supply 23 supply a voltage to the first and last of the electrodes 22 which is of the order of 50 to 100 kilovolts. Conductor 26 is connected to the last electrode 22*b* by means of a conductive strip 27 spaced from and substantially parallel and coextensive with the line of electrodes 22. However, the strip is immediately opposite the element of the electrode array and located on the inside of the cylindrical shell insulator 21 being affixed to the interior as best shown in dashed outline in FIG. 2. Such conductive strip provide for capacitive coupling between electrodes 22 and said conductive strip. During the sequential initiation of sparks between the electrode gaps conductor 26 and therefore conductor strip 27 are maintained substantially at cathode potential as will be discussed below.

Referring now to the remainder of the electric circuit for the electron gun as illustrated in FIG. 3 a high voltage supply unit 28 is coupled to both cathode supply 23 and grid bias supply 17. Both of these supply units 17 and 23 are coupled through isolating transformers 29 and 31 which along with high voltage supply 28 are coupled to a control console 32 through connector unit 33. All of the voltage supply units are in an enclosure 34 which is connected to shell 10 through the flange 36.

A comparator unit 37 senses the amount of grid current being drawn by grid 18, compares it to a reference amount and regulates cathode supply 23 in a manner to stabilize the plasma generated by the gun. For example, after the plasma is fully generated across the entire length of electrodes 22, excessive grid currents would otherwise occur unless the current provided by cathode supply unit 23 between lines 24 and 26 was considerably reduced.

In accordance with well-known vacuum tube theory, grid 18 is maintained at substantially the same potential as the cathode in order to control and regulate the flow of electrons to the anode.

While the electrodes may be of any number of which three is a lower limit, typically one would have a larger number, i.e., from 20 to 100 or more but, the number may be less or more depending upon the application. The thickness of the individual electrodes is not particularly critical although it is not expected that a thickness less than 1/1000 of an inch would be practical. As the thickness increases, the useful lifetime of operation of the electrode also increases until the thickness reaches a point at which erosion of the material from vaporization of the structure of the electrode causes preferential and undesired emission from the projections formed from the material remaining after erosion. Thus the lifetime cannot be extended beyond a practical limit directly related to about 2–3 millimeters thickness. Accordingly a range of thicknesses of the electrodes of the order of 1/1000 of an inch to 2 millimeters. Typical electrode materials are molybdenum, tungsten, copper or the heavy metals. The heavier metals are preferred because of low sputtering rate, high melting temperatures, and low erosion rates.

OPERATION

The emission of electrons necessary for the development of an electron beam is initiated by energizing cathode supply unit 23 through its control transformer 29 in control console 32 to place a voltage of from 50 to 100 kilovolts between conductors 24 and 26. Conductor 26 is initially maintained at cathode ground along with coupling strip 27. The capacitive effect of strip 27 holds down the voltage of the electrodes other than 22*a* toward ground to cause the first spark in the sequence to occur between electrode 22*a* and the next adjacent electrode 22*b*. Vaporization of the electrodes occurs and a plasma is thereby formed. The plasma typically includes approximately equal quantities of positive ions and electrons as is known. The first spark sets off a sequence of other sparks sliding or travelling serially across the array of electrodes 22. Thus, this forms a capacitively discharging sliding spark current and in a sequence which leaves from the first electrode 22*a* to the last electrode 22. The sliding spark occurs at a speed determined by the internal impedance of cathode supply 23 and the capacitance of the coupling between electrodes 22 and strip 27. The sliding spark progressively develops between successive electrodes in serial order until it exists throughout the extent thereof, after which it is maintained throughout.

Strip conductor 27, in providing interelectrode capacitive coupling between electrodes 22, effectively reduces the amount of voltage required for the operation of the spark circuit. For example, only that amount of voltage need be applied to breakdown the gap between the first electrode pair since successive gap, defined by adjacent electrode pairs appears electrically identical to the first pair once each preceeding spark has been established. Without the strip 27 a serial breakdown of all the gaps between electrodes 22 would require a much larger initial voltage, for example, proportional to the number of gaps in the electrode array.

Once the entire cathode has been activated the voltage difference between first electrode 22*a* and last electrode 22 may be of the order of a few volts or tens of volts. In order to prevent the plasma from increasing beyond the desired dimension, a feedback circuit including the comparator 37 (FIG. 3) senses the increase in grid current and reduces the current from the cathode supply 23. In other words, the current supply to the spark sources is reduced in order to reduce the spatial extension of the plasma. On the other hand, if the current of the screen grid falls it can be assumed that the drop is due to decay in the plasma and in order to restore it to a desired condition the current to the spark sources or electrodes 22 is increased by increasing drive from the cathode supply 23.

The electron gun of the present invention can be operated either in continuous mode or in a pulse mode. In continuous mode, the sliding spark is established usually within a very short period of time on the order of 1/10 of a microsecond for the configuration shown after which the cathodes supply is maintained continuously on as is the high voltage supply 28. Control of the device is affected by measuring grid current and comparing the same against a reference value with comparator 37, the output of which is used to regulate the current delivered by cathode supply 23.

The vacuum in which the electron gun operates internally in the present invention is any usual vacuum for electron guns, as for example, $10^6$ Torr. The following are typical operating parameters of one form of the present invention and are given solely by way of example.

| | |
|---|---|
| DC Operation | |
| Cathode Voltage | 250 kilovolts |
| Operating electron density | 0.1 milliampere/cm$^2$ |
| Pulsed Operation | |
| Cathode Voltage | 250 kilovolts |
| Pulsed - operating | |
| Electron density | 100 milliamperes/cm$^2$ |
| Pulse Length | 10 microseconds |

In the DC operating case the cathode screen voltage is of the order of tens of volts so while in the pulse operation case the cathode screen voltage may be much larger, for example, of the order of a few kilovolts.

In the pulse mode of operation either the high voltage or the cathode spark supply may be pulsed. However, it would be expected that both would be pulsed since pulse type supplies are more economical to construct and operate. As the length of the pulse defining the operation of the gun is decreased, the amount of grid adjustment as supplied by comparator 37 is also decreased so that for at the limit of extremely short pulses, for example of the order of microseconds, it is expected that a predetermined value of a cathode current control would be satisfactory.

To those skilled in the art in which this invention pertains, many adaptations and modifications will occur consistent within the disclosures given herein. For example, the present invention lends itself to the formation of a wide area electron gun by providing a plurality of rows of substantially identical construction or by developing the structure into a plane or sheet form in which a plurality of rows 22-1, 22-2 . . . 22-N of electrodes are positioned in spaced parallel alignment with respect to each other and over the area of the sheet. The interconnection of the various rows can be made in optional ways. For example, the rows may be interconnected in an alternating way to form a zig-zag, or connected in a meander pattern so that the sliding spark progresses down one row of electrons and back the other. Alternatively, the successive rows may be connected in parallel so that the spark progression is generally from one side of the array to the other in its progression. Accordingly, the claims herein are presented in a form of sufficient breadth to encompass either linear arrays in generally cylindrical geometry and planar arrays as above described.

What is claimed is:

1. A broad beam electron gun comprising: cold cathode means including an insulating substrate and a plurality of discrete electrodes disposed on said substrate to form a plurality of spark gaps therebetween lying along a path; anode means spaced from and juxtaposed with said cathode means; high voltage supply means connected between said cathode and anode means; cathode supply means for applying a voltage across said plurality of electrodes to generate a spark therebetween sequentially across each said gap resulting in the formation of a plasma in the space adjacent said cathode means, and a conductive strip spaced from and substantially coextensive with said electrodes for providing interelectrode capacitive coupling between said electrodes and said strip, said insulating substrate being a cylindrical insulator with said electrodes affixed along one side on the exterior of said insulator.

2. An electron gun as in claim 1 including a conductive strip affixed along the inside of said cylindrical insulator on the interior of said insulator said strip being coextensive with said electrons.

3. An electron gun as in claim 2 where said conductive strip is included in said cathode supply circuit.

* * * * *